US007073921B2

(12) United States Patent
Chen

(10) Patent No.: US 7,073,921 B2
(45) Date of Patent: Jul. 11, 2006

(54) ANTI-SHOCK FLASHLIGHT

(75) Inventor: Joy Chen, Burlingame, CA (US)

(73) Assignee: Pentagon Scientific Corporation, Burlinggame, CA (US)

( * ) Notice: Subject to any disclaimer, the term of this patent is extended or adjusted under 35 U.S.C. 154(b) by 0 days.

(21) Appl. No.: 10/861,396

(22) Filed: Jun. 7, 2004

(65) Prior Publication Data

US 2005/0168979 A1 Aug. 4, 2005

(30) Foreign Application Priority Data

Feb. 4, 2004 (TW) ..... 93201628 U

(51) Int. Cl.
*F21L 4/04* (2006.01)

(52) U.S. Cl. ..... 362/202; 362/208; 362/369; 362/390; 362/444; 362/445

(58) Field of Classification Search ..... 362/202, 362/110, 208, 369, 390, 444, 445
See application file for complete search history.

(56) References Cited

U.S. PATENT DOCUMENTS 4,827,385 A * 5/1989 Gammache ..... 362/206
6,004,008 A * 12/1999 Lai ..... 362/280

FOREIGN PATENT DOCUMENTS

DE 4303637 A1 * 8/1994

* cited by examiner

*Primary Examiner*—Sandra O'Shea
*Assistant Examiner*—Sharon Payne
(74) *Attorney, Agent, or Firm*—Rosenberg, Klein & Lee

(57) ABSTRACT

An anti-shock flashlight comprising a body, where there is an empty compartment inside. There is a male component on the top of the body. There is an anti-shock system comprising a holder, a headpiece and a spring. The holder slides onto the body, the headpiece is suspended on the top of the body; and the spring is fixed between the holder and the headpiece. There is also a light head device comprising a head screw and a light head. There is a female component, which is screwed onto the male component on the front of the body, on the head screw. The light head comprising a light bulb and a base is placed on the top of the interior of the headpiece. The base is suspended on the top of the interior of the body, in order to reduce recoil.

11 Claims, 5 Drawing Sheets

ANTI-SHOCK FLASHLIGHT

BACKGROUND OF THE INVENTION

1. Field of the Invention

The present invention relates to an anti-shock flashlight. More specifically, the present invention discloses a flashlight with anti-shock function, in order to assist in aiming and shooting.

2. Description of the Prior Art

Due to poor vision at nighttime, conventional shooting needs lighting to assist. Although, most profession guns are equipped with infrared lighting, the infrared system is expensive. Therefore, it is used for special purposes, and is not used for common purposes, such as hunting or shooting games. Furthermore, most guns are equipped with a filter for night vision. Therefore, adding a flashlight onto the gun for emission is commonly applied. However, recoil after shooting often damages the filament in the light bulb, so that the flashlight is damaged.

Due to the disadvantages and imperfections of the existing flashlight, the present invention solves the mentioned problems, and provides a flashlight with an anti-shock system; in order to provide a better, more economical and convenient product.

SUMMARY OF THE INVENTION

To achieve these and other advantages and in order to overcome the disadvantages of the conventional method in accordance with the purpose of the invention as embodied and broadly described herein, the present invention provides an anti-shock flashlight.

An objective of the present invention is to provide an anti-shock flashlight, so that the flashlight is not susceptible to shock when applied to a gun, in order to prevent the flashlight being damaged by recoil.

Another objective of the present invention is to provide an anti-shock flashlight, so that the flashlight can achieve the purpose of assisting shooting at nighttime; in order to enhance the added-value of the flashlight and make shooting at nighttime become more accurate and economical.

In order to achieve the objectives mentioned above and other objectives, the anti-shock flashlight comprises a body, where there is an empty compartment. There is a male component on the top of the body and an anti-shock system comprising a holder, a headpiece and a spring. The holder slides onto the body. The headpiece is suspended on the top of the body, and the spring is fixed between the holder and the headpiece. A light head device comprising a head screw and a light head is also provided. There is a female component, which is screwed onto the male component, of the body. The light head is placed onto the interior of the headpiece. The light head comprises a light bulb and a base, which is suspended in the interior of the body, in order to enhance the added-value of a flashlight and to assist shooting at nighttime.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
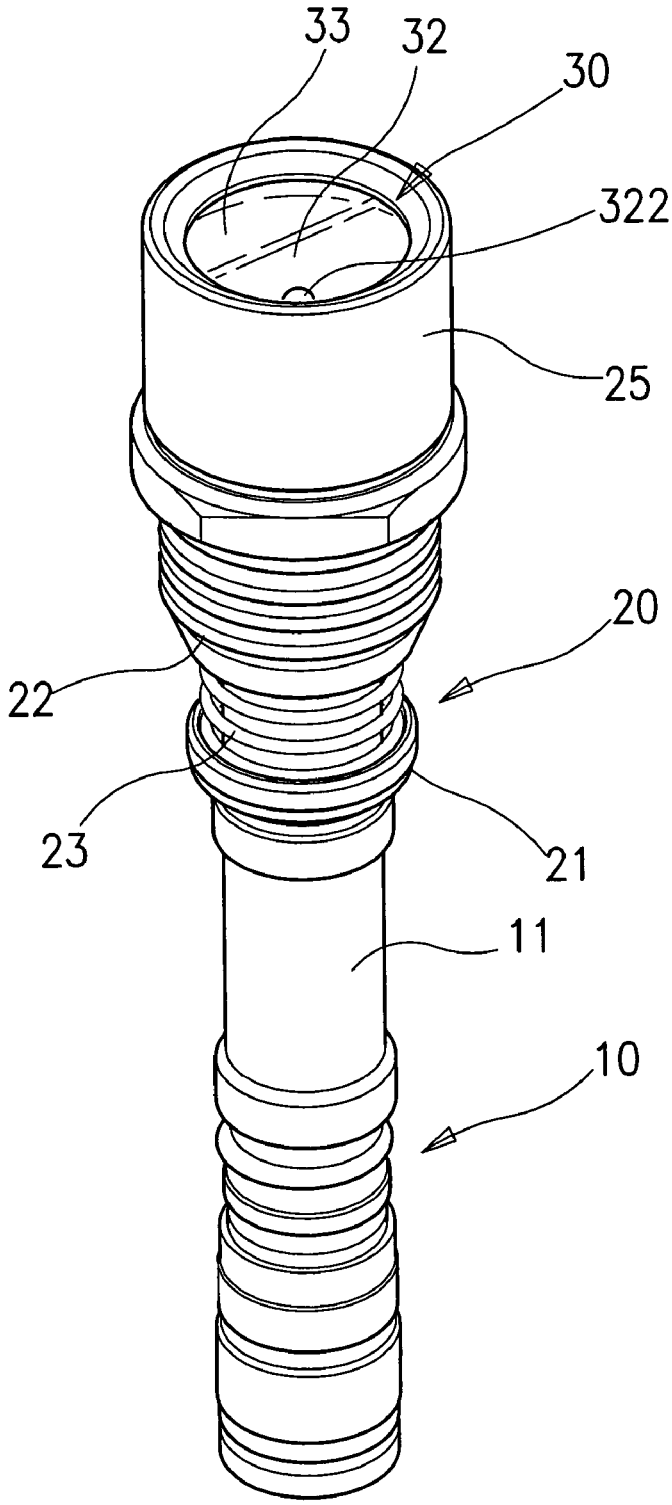
FIG. 1 is a 3-dimensional diagram illustrating components of an anti-shock flashlight according to an embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
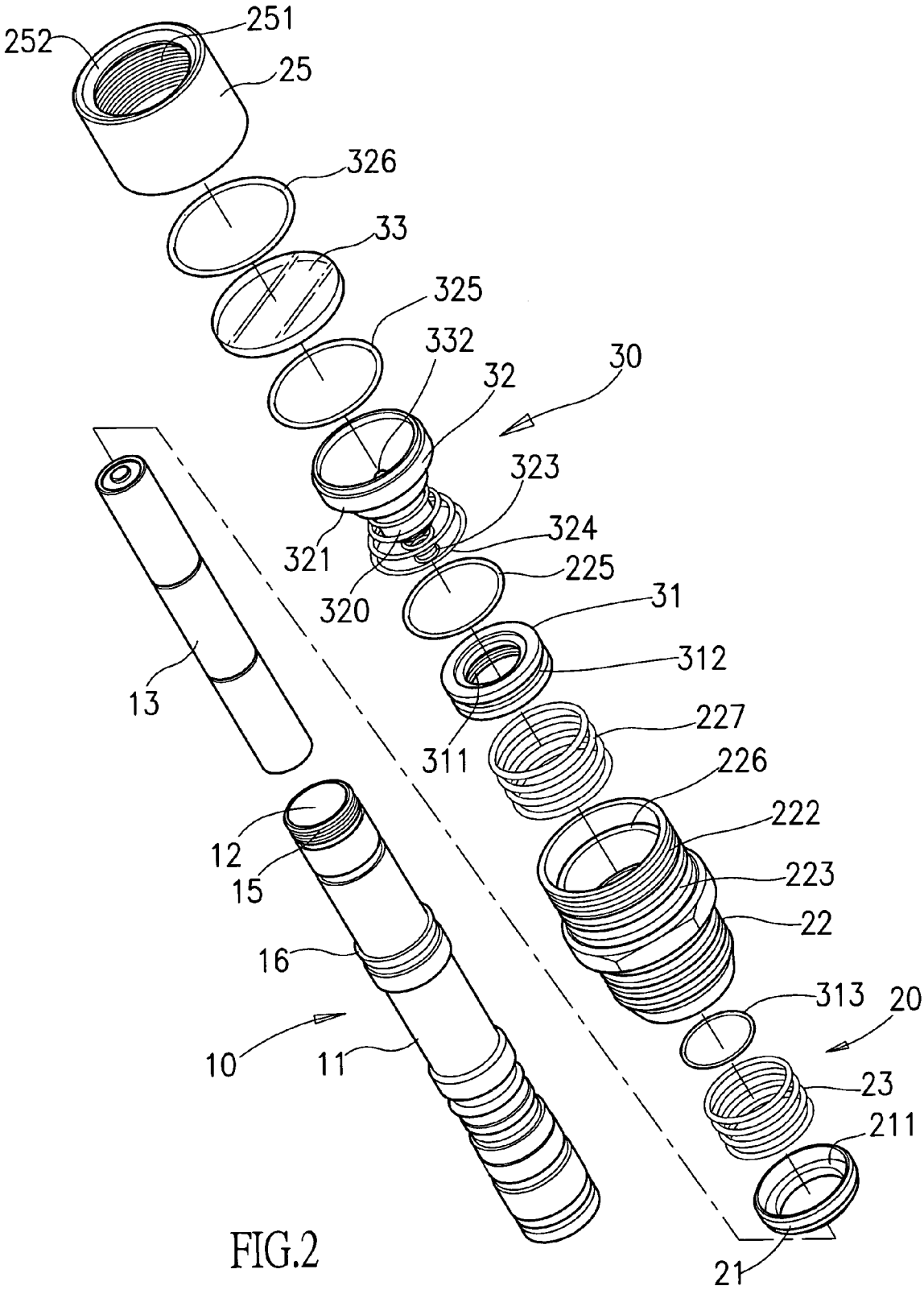
FIG. 2 is a diagram illustrating components of an anti-shock flashlight according to an embodiment of the present invention.
Figure 3:
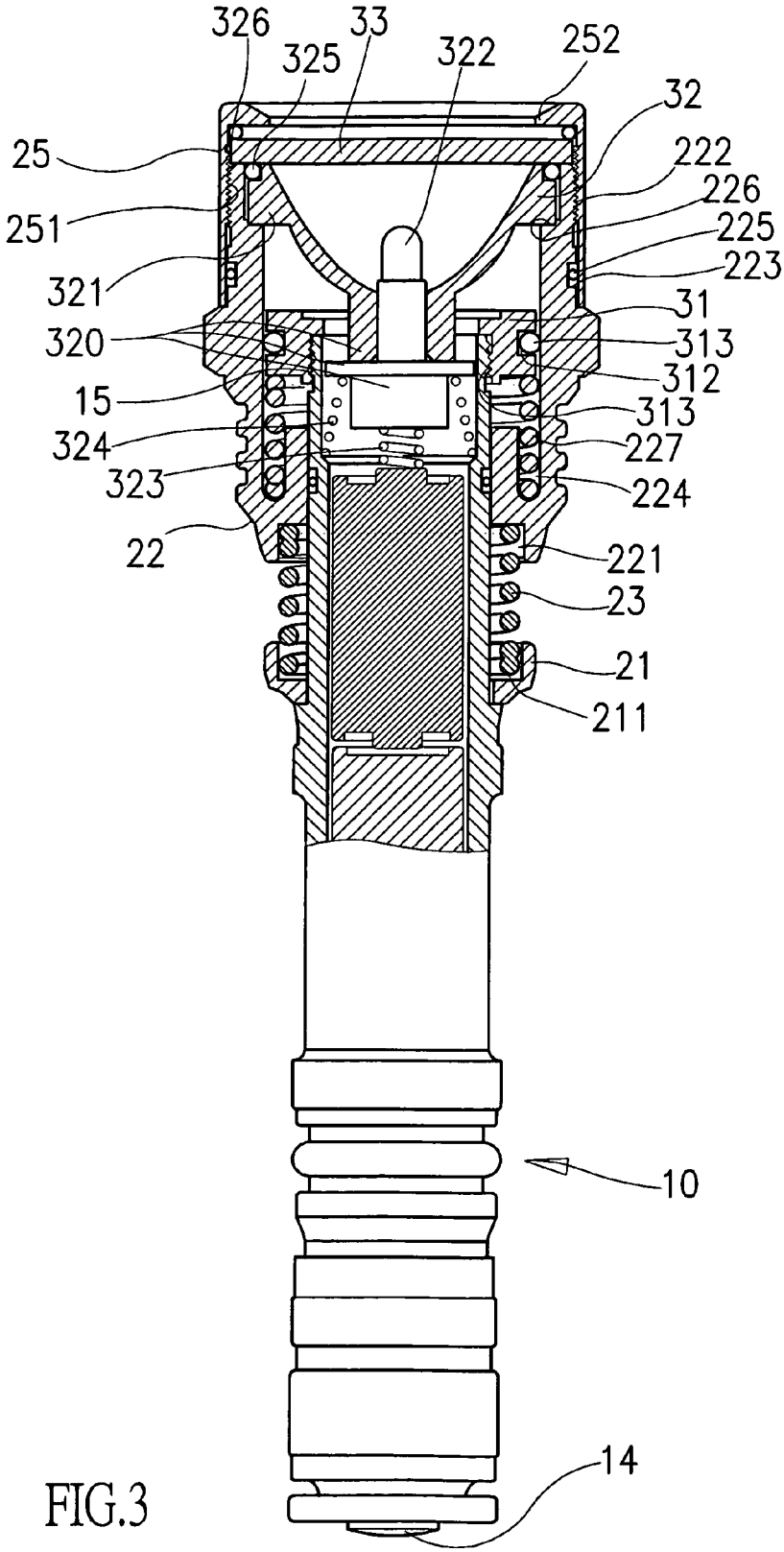
FIG. 3 is a partial cross-section illustrating an anti-shock flashlight according to an embodiment of the present invention.

Please refer to FIGS. 1–3. The present invention of an anti-shock flashlight comprises a body structure 10, an anti-shock system 20 and a light head device 30. The body structure 10 comprises a body 11, where there is an empty compartment 12 for storing batteries 13. There is a switch 14 on the end of the body 11 (as shown in FIG. 3). There is a male component 15 on the top of the body 11, and there is a stopper 16 on the appropriate position of the body 11. The anti-shock system 20 comprises a holder 21, a headpiece 22 and a spring 23. The holder 21, of which there is a groove 221, slides onto the stopper 16 of the body 11. Of course, the holder can be molded into one piece with the body 11. The headpiece 22 is suspended onto the top of the body 11. There is a groove 221 on the interior of the end of the headpiece 22, and there is a male component 222 and an O-shaped groove 223. The O-shaped groove 223 is used for placing an O-shaped ring 225. There is an inner groove 224 and a top socket 226 on the interior of the headpiece 22. (As shown in FIG. 3) There is a spring 227 in the inner groove 224. The headpiece 22 further comprises a head cover 25 screwed onto the exterior. There is a female component on the head cover 25, in order to screw onto the male component 222 of the headpiece 22. Due to the head cover 25 compressing the O-shape ring 225, it becomes waterproof. There is a top ring 252 stretched in on the top of the head cover 25. The spring 23 slides onto the body 11 and is fixed between the holder 21 and the grooves 211, 221 of the headpiece 22, in order to reduce shock from recoil.

The light head device 30 comprises a head screw 31 and a light head 32. The head screw 31 is a ring, where there is female component 311, to screw onto the male component 15 of the body 11, as well as fixing the spring 227. There is an O-shaped ring socket 312, where a ring 313 is placed on the exterior of the screw head 31. The light head 32 is placed on the top of the exterior of the headpiece 22. Due to the outer rim 321 holding the top ring 226 of the head piece 22, the base 320 of the light head 32 can be suspended on the top of the body 11. There is a light bulb 322 in the light head 32, which is fixed between the base 320, the battery 13, the inner guide spring 323 and the outer guide spring 324 on the top of the body 11. There is a convex lens 33 on the top of the light head 32. There is a ring 325 between the convex lens 33 and the top ring 252 of the head cover 25, in order to be waterproof.

Figure 4:
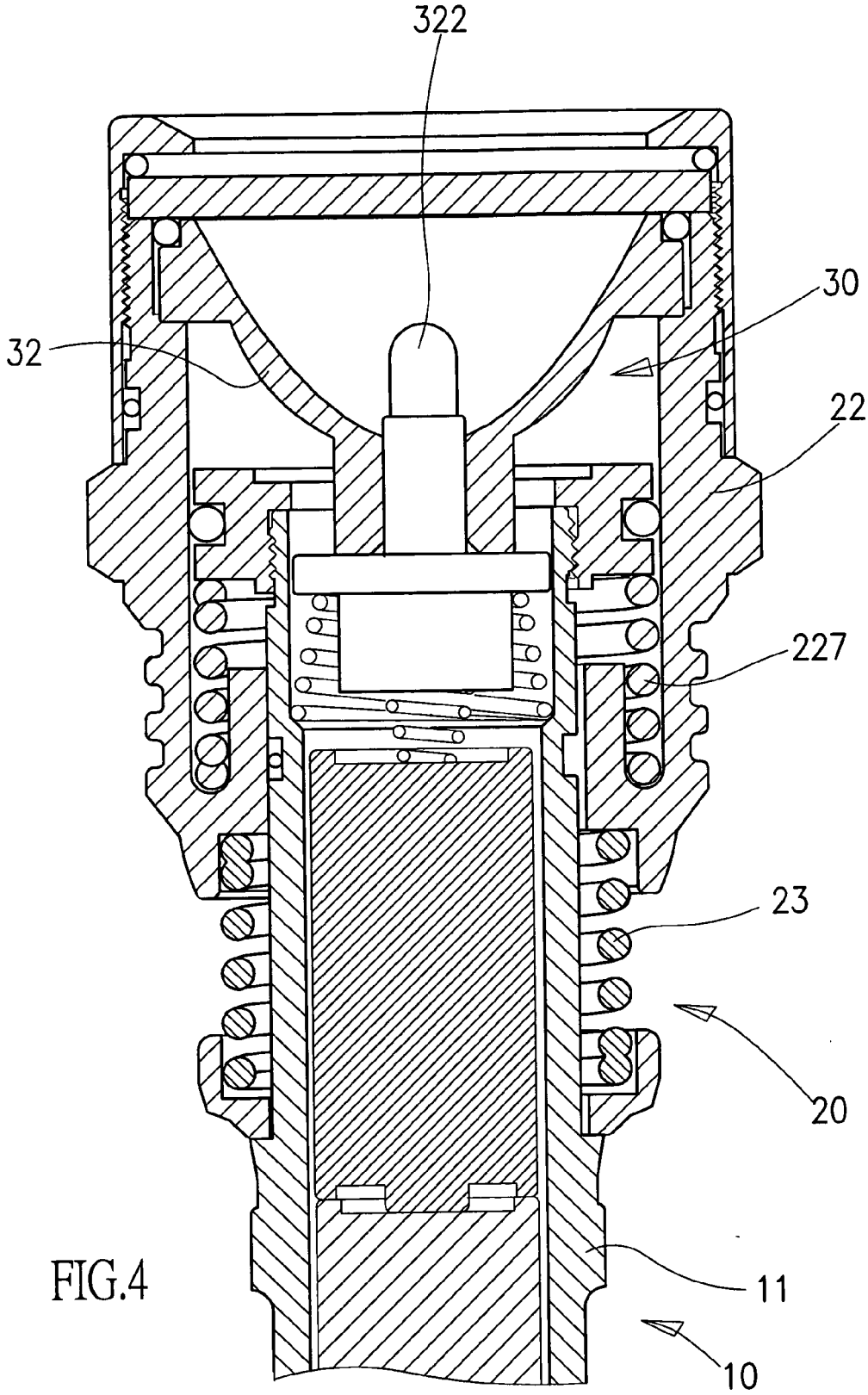
FIG. 4 is a partial blow-up cross-section illustrating an anti-shock flashlight according to an embodiment of the present invention.
Figure 5:
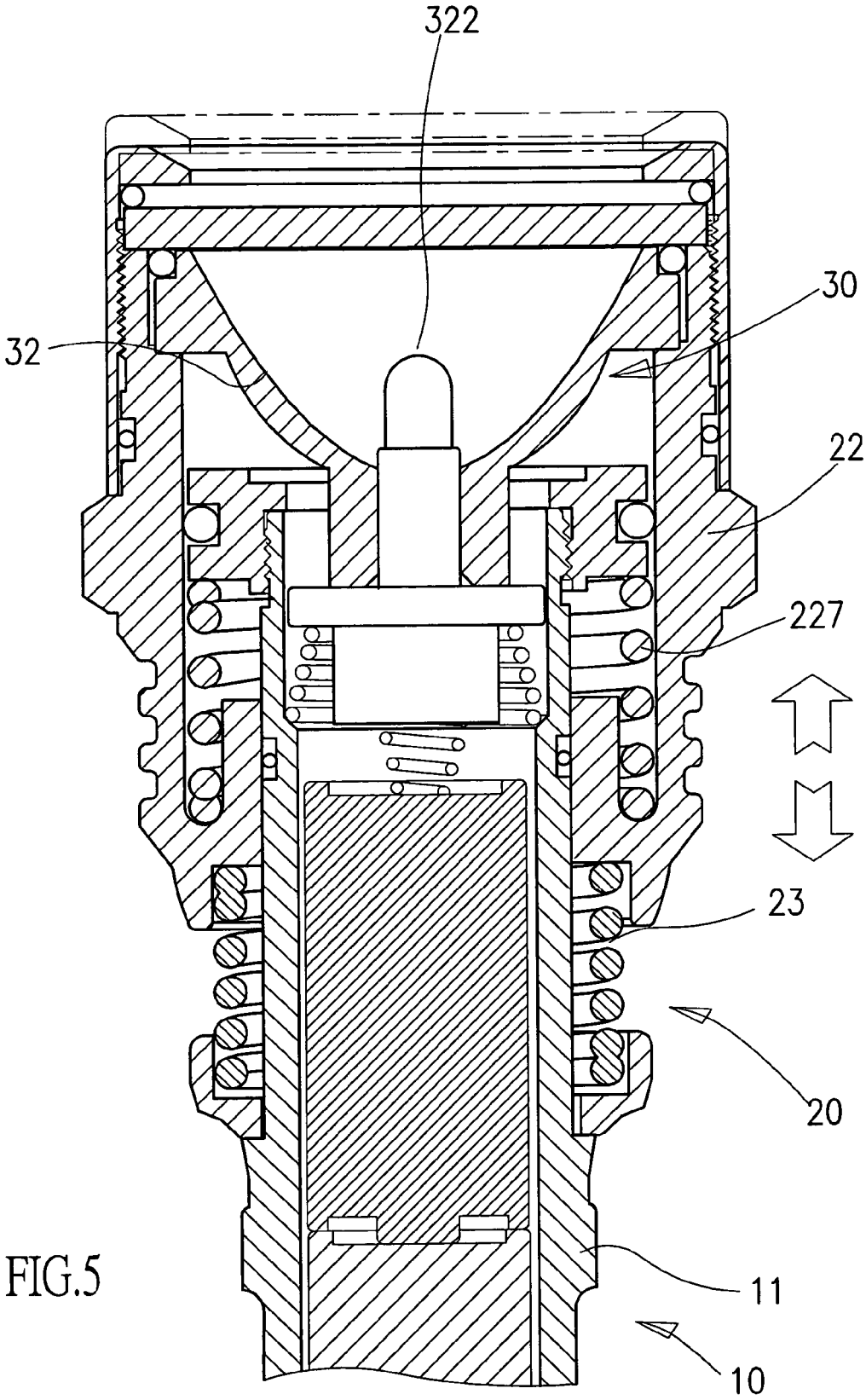
FIG. 5 is a partial blow-up cross-section illustrating an anti-shock flashlight when in use according to an embodiment of the present invention.

A clamp or an object to fix the anti-shock flashlight onto a gun should be applied. As shown in FIGS. 4 and 5, recoil produced after shooting makes the body 11 shake. Since the head piece 22 is suspended onto the top of the body 11, the head piece 22 presses the spring 227 and stretches the spring 227 after receiving the force, so that the light head 32 moves backwards, in order to balance the shock wave. In doing so, the filament in the light bulb 322 is protected from shock.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. An anti-shock flashlight comprising:

a body with a compartment for holding at least one battery;

a first component on top of the body;

an anti-shock device comprising a holder, a head piece and a spring; the holder sliding onto the body; the head piece suspended on top of the body; and the spring fixed between the holder and the head piece;

a light head device comprising a head screw and a light head; the light head comprising a light bulb and a base placed on top of an interior of the head piece; the base suspended on top of the interior of the body, in order to reduce shock from recoil; and a second component on the head screw; the second component screwed onto the first component on the body.

2. The anti-shock flashlight of claim 1, further comprising:

a stop ring on the body to position the holder.

3. The anti-shock flashlight of claim 1, whereby the holder is molded into one piece with the body.

4. The anti-shock flashlight of claim 1, further comprising:

a groove on the holder to position the spring.

5. The anti-shock flashlight of claim 1, further comprising:

a groove on the bottom of the interior of the head piece to position the spring.

6. The anti-shock flashlight of claim 1, further comprising:

an O-shaped groove storing an O-shaped ring on top of an exterior of the head piece.

7. The anti-shock flashlight of claim 1, further comprising:

a groove on the interior of the head piece to store a spring; the spring fixed onto the head screw.

8. The anti-shock flashlight of claim 1, further comprising:

a top ring on the top of the interior of the head piece to position the light head.

9. The anti-shock flashlight of claim 1, further comprising:

an inner guide spring and an outer guide spring between the bottom of the light head, the battery and body.

10. The anti-shock flashlight of claim 1, further comprising:

a convex lens on top of the light head with an o-shaped ring in between.

11. The anti-shock flashlight of claim 10, further comprising:

an o-shaped ring between the convex lens and the head cover.

* * * * *